US005611442A

United States Patent [19]

Howard

[11] Patent Number: 5,611,442

[45] **Date of Patent: *Mar. 18, 1997**

[54] GONDOLA RACK MODULAR STACKING SYSTEM

[75] Inventor: John D. Howard, Temple, Ga.

[73] Assignee: L&P Property Management Company, Chicago, Ill.

[ * ] Notice: The term of this patent shall not extend beyond the expiration date of Pat. No. 5,477,971.

[21] Appl. No.: 577,207

[22] Filed: Dec. 22, 1995

Related U.S. Application Data

[63] Continuation of Ser. No. 235,295, Apr. 29, 1994, Pat. No. 5,477,971.

[51] Int. Cl.[6] ..... A47F 5/00

[52] U.S. Cl. ..... 211/187; 211/189; 108/108

[58] Field of Search ..... 211/187, 94, 90, 211/103, 59.2, 189, 175, 193, 191, 186; 108/108, 109

[56] References Cited

U.S. PATENT DOCUMENTS

| | | |
|---|---|---|
| D. 325,488 | 4/1992 | Sheriff . |
| 2,987,195 | 6/1961 | Smith . |
| 3,101,681 | 8/1963 | Streater . |
| 3,199,464 | 8/1965 | Shook . |
| 3,425,568 | 2/1969 | Albright . |
| 4,274,687 | 6/1981 | Bayles et al. . |
| 4,312,086 | 1/1982 | Bianco . |
| 4,526,110 | 7/1985 | Franz . |
| 4,634,010 | 1/1987 | Otema . |
| 4,720,016 | 1/1988 | Kay . |
| 4,809,855 | 3/1989 | Bustos . |
| 5,160,051 | 11/1992 | Bustos . |
| 5,197,610 | 3/1993 | Bustos . |
| 5,205,421 | 4/1993 | Bustos . |
| 5,253,770 | 10/1993 | Rosenthal . |
| 5,350,073 | 9/1994 | Thornley et al. . |
| 5,477,971 | 12/1995 | Howard ..... 211/187 |

*Primary Examiner*—Robert W. Gibson, Jr.
*Attorney, Agent, or Firm*—Wood, Herron & Evans, P.L.L.

[57] ABSTRACT

A gondola rack stocking system that includes a rack having a base, a plurality of vertical standards spaced along the base and configured to support gondola shelves on gondola shelf brackets thereon is combined with a high density subassembly that includes a pair of horizontal rails connectable to the standards uprights, preferably in fixed lengths corresponding to the spacing of the standards. Vertical rectangular frame uprights connect at any of a plurality of positions along the rails and also at their bottoms to the foot of the rack base. Variable width shelf sets are connectable at vertically spaced positions on the uprights and at the top of the uprights. Conventional gondola rack shelving supplements the shelves to optimize the flexibility of the system configuration. Maximum packout is thereby provided.

23 Claims, 3 Drawing Sheets

GONDOLA RACK MODULAR STACKING SYSTEM

This application is a continuation of application Ser. No. 08/235,295, filed Apr. 29, 1994, now U.S. Pat. No. 5,477,971.

The present invention relates stocking systems for use in combination with shelving systems of the gondola rack type. More particularly, the present invention relates to modular retail storing and display shelving systems for large package items and for various combinations of large and small items.

BACKGROUND OF THE INVENTION:

In the layout of retail stores for the sale of many products, but particularly in the marketing of food, pet supplies, certain hardware and other types of goods that are packaged and stocked in a variety of quantities in labeled containers for display, a primary consideration is the maximization of product "packout", which is the term used for the stock density per unit area of retail floor space available for items that are for sale. The objective of maximizing product packout includes not only presenting the products in a manner that they are readily visible to the customer, but providing a stocking of quantities sufficiently large to supply customer demand without constant restocking. In attempting to satisfy this objective, consideration must be made not only of the volume of product being moved, but also the relative volumes of different related products or products of different package sizes that must, by their nature, be stocked and displayed together.

In the design of a stocking system, the flexibility of the display rack arrangement is a key to the ability to maintain optimum packout of a stocking system as the nature of the available products and the demands of customers change. This has resulted in the provision of a variety of adjustable shelving systems, most having some claim to advantage over others and each having shortcomings and leaving room for improvement.

A retail stocking system that has been developed and accepted widely in the food and feed industries is that known as the gondola rack. The gondola rack is a display and storage shelving system made up of a plurality of vertical uprights or standards that are secured to the rear of a load-bearing base. The standards so supported are strong enough to remain in place and support the loads of cantilevered shelves which extend forwardly over the base. The standards are typically positioned at fixed standard distances apart, of, for example, four feet on centers.

Shelving is supported on the standards of a typical gondola rack by shelf brackets that carry hooked tabs arbitrarily insertable in any of a series of holes in the standards that are vertically spaced at incremental distances apart, typically at regular intervals of, for example, each inch above the floor. The brackets are provided in various strengths and lengths to allow the flexible arrangement of shelves of a variety of sizes and load bearing capacity.

Unfortunately, the flexibility of the conventional gondola racks is limited. Bagged goods such as, for example, grain and animal food frequently are supplied in quantities of from one pound to forty or fifty pounds per bag. Conventional gondola shelving, four feet in width, even when used with the strongest brackets, shelves and standards, can accept stacks only of limited heights. Often, the full width of the shelves is too wide for the quantities being stocked, when the units are stacked to optimum space saving efficiency.

Thus, the different products or sizes of products are must be mixed on the shelves and are thereby insufficiently divided and become disarranged by the customers helping themselves to the goods. As a result of such shortcomings of gondola shelves, such systems often have needed to be supplemented by totally separate less flexible systems to hold the larger and heavier containers of products. Such racks may have closer spaced vertical supports and support the shelves also at their fronts. This has required either that the smaller quantity containers of the same product be stocked separate from the larger quantities of the same product on less heavy duty shelves, or stocked on the upper shelves of the heavy duty racks which are stronger and more expensive than necessary to support the small item loads. In addition, these heavy duty shelves are less flexible, and cannot be readily reconfigured when products and quantity requirements change.

Accordingly, there is a need in the retailing industry, particularly for the sale of food, feed, and packaged fungible products, for a gondola rack based stocking system that has the ability to support for display a wider variety of packaged quantities of products with greater optimization in the packout of the stocked items.

SUMMARY OF THE INVENTION:

It is a primary objective of the present invention to provide a gondola rack stocking system having flexibility of configuration and high packout and load-bearing capacity. It is a further objective of the present invention to provide a gondola rack based sub-system that is compatible with conventional gondola rack arrangements and, when combined therewith, greatly increase the configuration flexibility of the system and packout of the retail facility.

In accordance with the principles of the present invention, there is provided stocking system sub-assembly connectable to the elements of a standard gondola rack product storage and display system that provides for the arrangement of large and small packages of product in highly flexible arrangements. The stocking system sub-assembly of the present invention is configurable in modules that are preferably of various widths that are independent of the standard spacing of the gondola rack uprights. The subassemblies are securable to the vertical uprights or standards of the conventional gondola rack, may also connect to the rack base, and may be configured in an arrangement along with conventional gondola rack shelving to produce an enhanced gondola rack stocking system for the stocking of large bags and other large containers of products in combination with small and intermediate size containers of the same or related products.

In the preferred embodiment of the present invention there is provided a gondola rack storing and display system in combination with a modular large container stocking subassembly. The subassembly includes a plurality of horizontal carrier rails, preferably made in sections to lengths that equal the standard spacing of gondola rack uprights, usually four feet, which are connectable, preferably at each end, at any of the standard spaced shelf bracket receiving holes in the gondola rack uprights. The subassembly further includes a plurality of upright frame members each connectable to the carrier rails on the gondola rack at a variety of horizontal frame supporting positions provided along the rails. The upright frame members so connected are supported vertically so as to extend perpendicularly away from the supporting partition holding the gondola standards. To achieve this, the uprights preferably also engage fixed holes or other structure in a stationary base of the gondola rack system.

The upright frame members have a plurality of shelf supporting positions thereon that support shelf units, preferably at their fronts and backs, at various heights extending between two adjacent upright frame members. Preferably, the assembly is provided with accommodation for standard gondola shelving above or adjacent to the large container subassembly to enhance the flexibility of the overall system by supporting small and intermediate size related items.

In the preferred embodiments, the carrier rails are each provided with a plurality of hook receiving notches or holes spaced at equal horizontal distances thereafalong, for example, at regular one inch intervals. The frame members are preferably rectangular in shape, having a vertical rear support, a vertical front support, and a top and bottom horizontal cross support rigidly connecting the tops and bottoms, respectively, of the vertical supports. Preferably also, the vertical supports have a series of slots or holes, similar to the holes of the standard uprights of the gondola rack, that receive tabs of modular shelving. Unlike the standard shelves of the gondola rack, the shelves of the large package subassembly are preferably supported at both their fronts and backs, near the four corners thereof, to the vertical supports of the upright frames.

The stocking system of the present invention preserves the advantages of the conventional gondola rack while further providing for the optimal use of floor space in storing and displaying large container products along with small container versions of the same and related products. The advantages are provided in the form of an add-on subassembly for existing gondola rack systems that allows for the accommodation of narrower and high load bearing shelves of a wide variety of sizes and shapes, permitting optimal or maximum packout of the facility.

These and other objectives and advantages of the present invention will be more readily apparent from the following detailed description of the drawings of the preferred embodiment of the invention, in which:

DETAILED DESCRIPTION OF DRAWINGS

Figure 1:
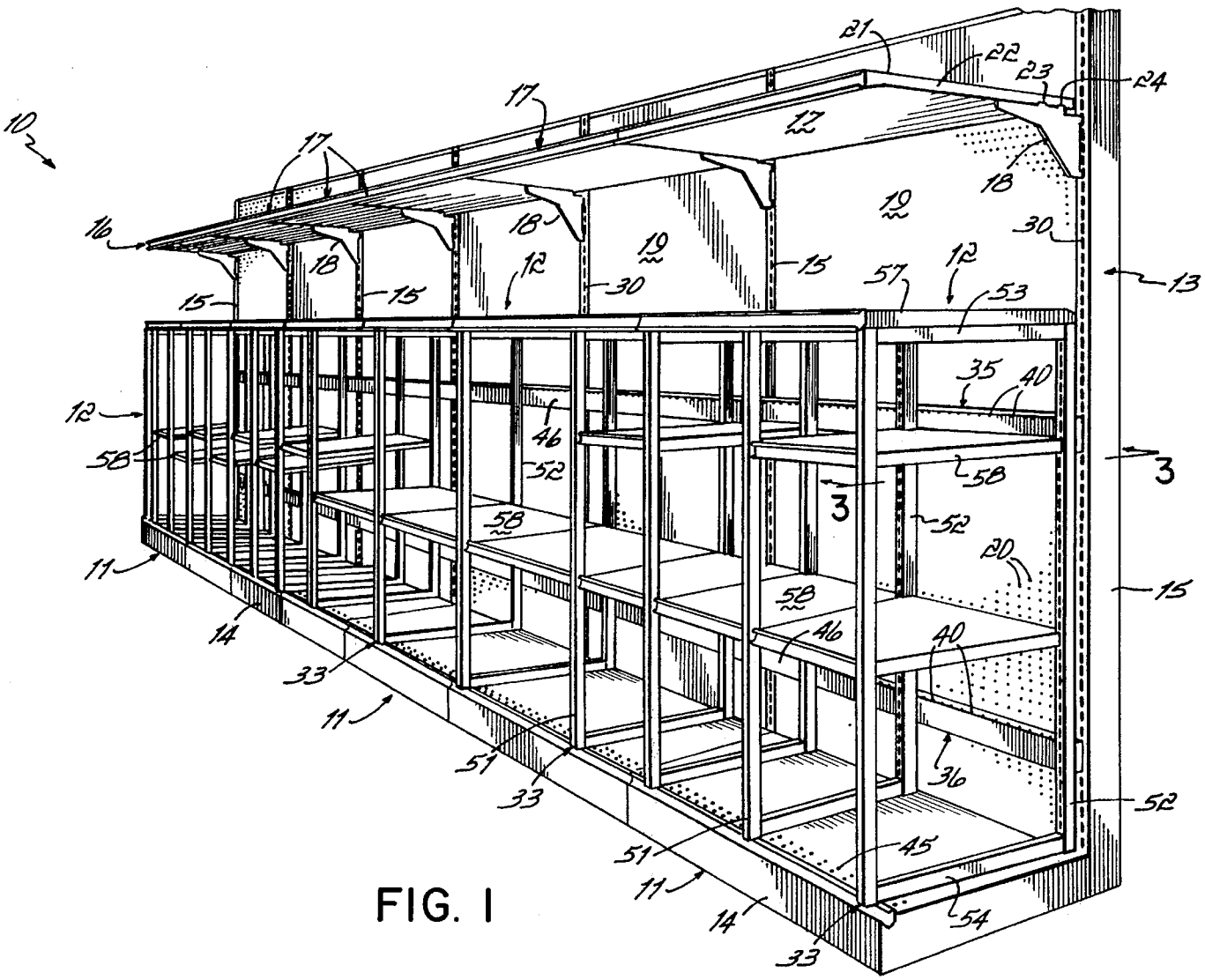
FIG. 1 is a perspective view of a gondola rack stocking system in combination with a modular large container item stocking system subassembly according to one preferred embodiment of the present invention.

FIG. 1 illustrates one preferred embodiment of a stocking system 10 according to principles of the present invention. The stocking system 10 is formed of a combination of a conventional gondola rack storage and display unit 11 and a modular subassembly 12 for the stacking and display of packaged items such as large bag items of animal food, gardening and yard supplies, and products related thereto that are of different quantities and types. The system 10 is typically installed in a grocery store, a feed store, a hardware store or other type of retail sales facility from which a variety of items, many which are variable sized packages of fungible foods or building or household materials, are stocked and displayed for sale to the ultimate consumers.

The conventional gondola rack unit 11 around which the system 10 of the present invention is typically configured in the form of a planar vertical panel that serves as an aisle divider or planar partition or structure 13. The panel 13 is supported on a horizontal foot 14 rigidly fixed relative to the partition 13 and extends forwardly from the partition 13 to function as a free standing aisle divider. The panel 13 and foot 14 may be referred to as a gondola rack base. The gondola rack unit 11 includes a plurality of vertical standards 15 that are mounted at horizontal distances on, or are integral part of, the partition 13 of the gondola rack base, and are usually spaced at standard intervals of 48 inches. The standards 15 are customarily strong enough to support multiple shelves of several hundred pounds of cantileverd loads each. The standards 15 typically are part of the structural framework of the partition 13.

The conventional gondola rack unit 11 typically includes a plurality of gondola shelves adjustably installed on the standards 15 at several levels extending along the standards 15. Only one such row 16 of standard gondola shelves 17 is illustrated in FIG. 1. Each of the shelves 17 is supported at each side thereof by a gondola shelf bracket or gusset 18 to an adjacent pair of the standards 15. On the partition 13 between each of the standards 15 is frequently provided a peg board 19 having a rectangular array of holes 20 therein, in rows and columns of for example one inch by one inch, to provide for the mounting of light duty display elements and to serve as a reference grid to aid the arrangement of the display.

Figure 2:
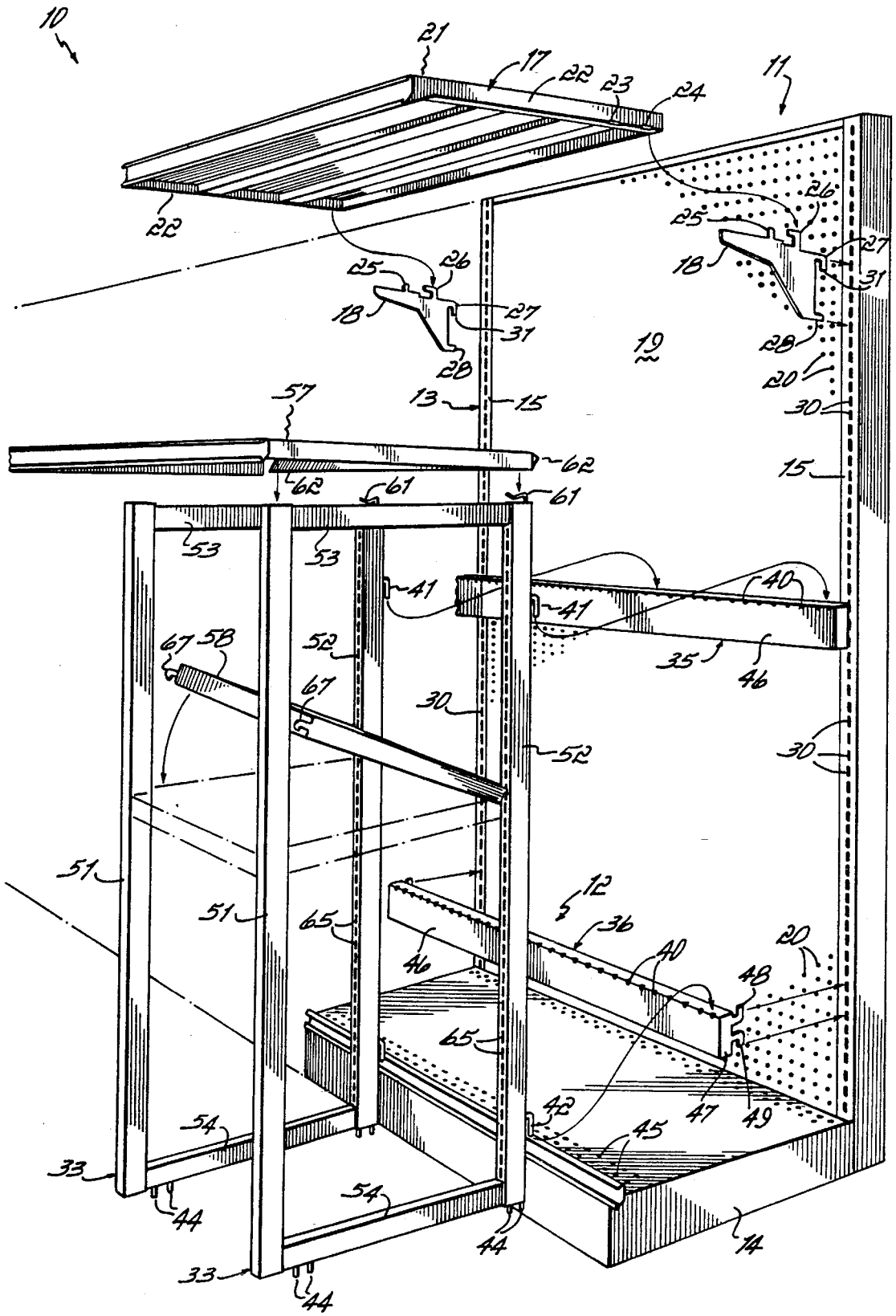
FIG. 2 is an exploded perspective view of a portion of the stocking system of FIG. 1.

In FIG. 2, the conventional gondola rack shelf support structure is illustrated in more detail. Each of the shelves 17 has a horizontal product supporting surface 21 and a pair of opposite side rails 22 usually integrally formed with the supporting surface 21 from a single piece of sheet metal. Each of the side rails 22 has a pair of holes 23, 24 in the bottom thereof near the back edge of the shelf 17. The holes 23,24 are configured to fit over a pair of tabs 25, 26 in the top edge of one of the brackets 18. Typically, one tab 25 is a simple rectangular tab while the other tab 26 is hooked, so that, when a shelf 17 is set on the bracket 18 with the tabs 25,26 inserted respectively in the holes 23,24 of a rail 22, the shelf 17 can be slid forward relative to the bracket 18 to lock the shelf to the bracket 18.

The bracket 18 is further provided with a pair of tabs 27,28 in the rear edge thereof. The standards 15 are provided with a plurality of vertically spaced holes 30, usually spaced at vertical intervals, equal between centers, customarily of one inch. The tabs 27,28 are dimensioned and spaced to fit, either individually or with two brackets 18 side-by-side, into two of the holes 30 of the standards 15. Usually, the upper one 27 of the tabs has a relatively long downwardly extending hooked end 31 while the lower one 28 of the tabs has a straight rectangular tab, sometimes with relatively short downwardly extending hooked end. So configured, the upper tab 27 and lower tab 28 are aligned and inserted into holes 30 of a standard 15. Then the bracket is slid down until lower tab 28 rest on bottom of the lower hole 30 upper tab 27 of a bracket 18 is first inserted into a hole 30 of a standard 15, then the bracket 18 is slid upwardly to the maximum extent, and then the lower tab 28 is inserted into a lower one of the holes 30. Then the bracket 18 is slid downwardly until the lower tab 28 rests on the bottom of the hole 30, and the hooked end 31 of the upper tab 28 extends below the lower end of its respective hole 30, whereby the bracket 18 is supported by the lower tab 28 against downward vertical load by bracket 10 and by the upper hooked end 31 of the upper tab 27 against downward rotation of the bracket due to cantilevered loads on the bracket 18.

The large container subassembly 12 of the stocking system 10 is illustrated in FIGS. 1 and 2. The subassembly 12 is formed of at least one horizontal carrier rail, and preferably a pair of rails including an upper rail 35 and a lower rail 36. The subassembly 12 also includes a plurality of vertical upright frame members 33. Each of the frame members 33 is configured to be attached at the upper back thereof to the rail 35 and also near the lower back thereof to either a lower rail 36 or the base foot 14 or both, so that the upright frame member 33 is attachable to extend perpendicular to the partition 13 and remain fixedly secured in that position.

Connectors are provided for securing the upright frame members 33 to the carrier rails 35,36. The connectors are made up of structure at least partially carried by the upright frame members 33 for engaging the rails 35,36. In the preferred embodiment of the invention, the cooperating structure on the rails 35,36 is in the form of a plurality of holes or recesses 40 in the carrier rails 35,36 into which connectors, preferably in the form of upper and lower hooks 41 and 42 are fixed to the upright frame members 33. The carrier rails 35 and 36 are provided with the plurality of recesses or holes 40 spaced preferably at equal intervals of, for example, one inch along the top of the rails 35,36, to receive the upper and lower hooks 41,42, respectively, that project outwardly and downwardly from the backs of the upright frame members 33.

In the preferred embodiment, the frame members 33 also at least partially carry frame bottom connectors that connect the bottoms thereof with the foot 14 of the base. Preferably, these connectors include downwardly extending pins 44 on the bottom of the frame members 33 and holes 45 in the base foot 14. When the hooks 41,42 are inserted into holes 40 in rails 35,36, the pins 44 drop into further sets of holes 45 in the top surface of the base foot 14 to lock the frame member 33 in an orientation perpendicular to the partition 13. The sets of holes 45 are positioned so as to align horizontally with corresponding holes 40 in the carrier rails 35,36.

Figure 3:
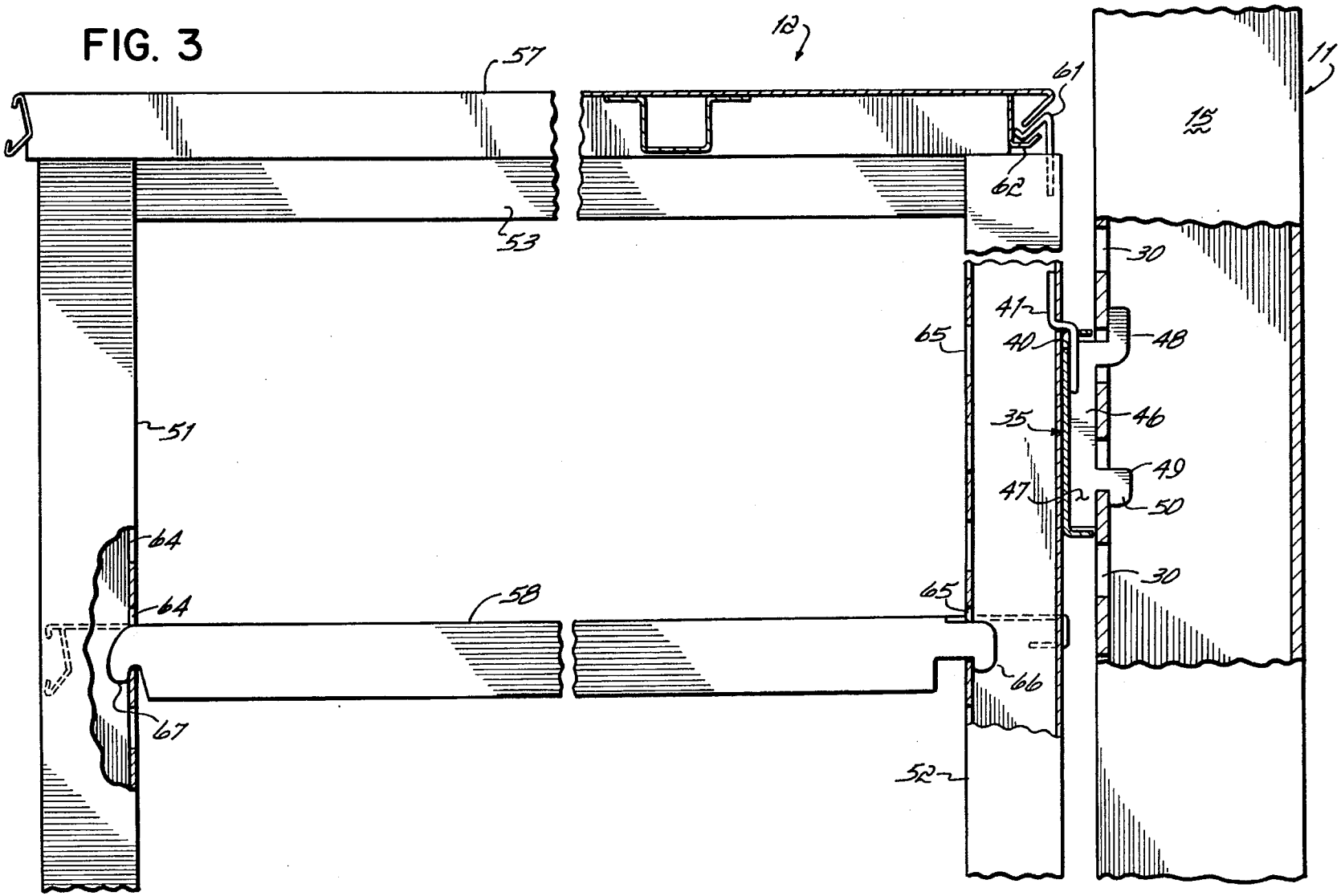
FIG. 3 is a side elevational view, partially in cross-section, along the line 3—3 of FIG. 1.

In general, the frame members 33 are preferably connected so as to be fixed relative to the standards 15 in a vertical orientation, perpendicular to the structure 13 and base, without dependence on interconnecting structure or shelving, although the latter alternative can also be provided. To maintain such orientation, each frame member 33 is provided with one top connection to a rail 35 near the top of the member 33 and at least one anchor connection at the bottom of the member 33. The anchor connection includes preferably one connection to the base foot 14 at the bottom front of the members 33, and another connection either to a lower rail 36 or the base foot 14 near the bottom back of the members 33 or to both, as described for the illustrated embodiment. The anchor connection could alternatively be provided with one or more angle brackets to hold the member 33 vertically or perpendicular to the plane of the partition 13, The carrier rails 35 and 36 are illustrated in detail in FIGS. 2 and 3. Preferably, the rails 35,36 are formed in sections 46, each having a length equal to the conventional spacing of the standards 15 on the partition portion 13 of the base. At each end of each rail 35,36 is a bracket plate 47 formed from an integral piece of sheet metal of rail 35, 36. The plates 47 have upper and lower hooked tabs 48 and 49, respectively. The upper tabs 48 have relatively long upwardly hooked ends while the lower tabs 49 have shorter downwardly hooked ends 50. The brackets. 47 enable the rail sections 46 to be firmly secured to the vertical standards 15 of the gondola rack 11, and to be arranged end to end across consecutive pairs of standards 15 to form rails 35,36 extending the width of several of the 48 inch sections of the gondola rack 11. The rails 35, 36 are installed on the standards 15 by first inserting the longer upper tabs 48 of the brackets 47 on each end of the rail section 46 in a respective one of the holes 30 of each of a selected pair of adjacent standards 15. Then, the rail section 46 is lifted until the upper tab 48 abuts the top of the upper one of the selected holes 30, whereupon the lower tab 49 is aligned with an fit into the lower one of the selected holes 30 on the standard 15. Then the rail section 46 is lowered until the lower tab 49 rests on the bottom of the respective hole 30, with its hooked end 50 preventing the bottom of the bracket 47 from moving away from the standard 15. As with the shelf bracket 18, the longer upper hook 48 remains above the top of the hole 30, thus preventing the top of the rail section 46 from being removed from the standard 15, unless and until the rail section 15 is lifted and the bottom tab 49 is first removed from the respective hole 30. The rail sections 46 thus installed on the standards 15 form a strong structural horizontal support to which the vertical upright frame members 33 are connected.

The detailed structure of the preferred embodiment of the frame members 33 is illustrated in FIG. 2, which shows the frame members 33 as rectangular, having front and back vertical supports 51 and 52, respectively, and upper and lower cross supports 53 and 54 respectively, which are preferably horizontal, rigidly connected at their ends together, with the front support 51 spaced or offset from the back support 52, to preferably form a rigid rectangular frame. The hooks 41 and 42 are rigidly attached to the backs of the back supports 52 of each of the frame members 33, and the pins 44 are rigidly attached to the either the lower cross support 54 or the lower ends of the front and back supports 51 and 52, such that, when the rails 35 and 36 are properly spaced on the standards 15, the hooks 41,42 can be simultaneously inserted into a hole 40 in each of the rails 35,36 and the pins 44 will drop into corresponding holes 45 in the base foot 14.

A main purpose of the upright frame members 33 is to support shelves of a variety of widths and with a strength of which the conventional gondola rack 11 alone is incapable, and to do so in a variety of configurations, thus providing a greater product density. The frame members 33 are configured to have a plurality of vertically spaced shelf rest positions thereon to support two kinds of shelves, the top shelf 57 and the lower shelves 58. For attachment of a top shelf 57, a topmost shelf rest position is provided that includes the upper end of the supports 51,52 of each frame member 33. The back support 52 is provided with a clip element 61 under which is inserted a cooperating tongue 62 on the back edge of the upper shelf 57. For attachment of the lower shelves to the frame members 33, a plurality vertically spaced shelf rest positions are preferably defined by sets of holes 64,65, preferably spaced at equal increments of one or two inches apart, respectively in the back surface of the front support 51 and at corresponding heights in the front surface of the back support 52. Each of the lower shelves 58 is provided with a rear tab 66 on each side of the shelf at the back end thereof and a front tab 67 at each side of the shelf at the front end thereof. Each of the tabs 66,67 has a downwardly hooked end.

Installation of the upper shelf 57 is achieved by inserting the tongue 62 under the clip element 61 with the shelf 57 tipped upward at the front, and then lowering the shelf 57 to a level orientation against the top supports 53 of the frame 33. The front of the shelf 57 is then preferably secured in place by screws (not shown) to the tops of the front supports 51 of each of the frame members 33, thus contributing to the rigidity of the frame members 33. Installation of the lower shelves 58 is achieved by inserting the rear tabs 66 into holes 65 in the back supports 52 of the frames 33 on each side of the shelf 58, with the front edge of the shelf 58 tilted upwardly. Then the shelf 58 is lowered to a horizontal position which brings the front tabs 67 in line with the holes 64 on the front supports 51 of the frame 33 on each side of the shelf 58. Then the shelf is pulled forwardly until the tabs 67 are inserted into the holes 64, whereupon the shelf is lowered slightly so that the hooked ends of the tabs 67 hold the shelf 58 in position in the holes 64. The lower shelves may also be locked in such positions with screws (not shown).

Referring again to FIG. 1, it can be seen that a variety of shelf arrangements can be formed by placing the upright frame members 33 at different spacings along the rails 35,36 and inserting shelves of different widths and at different vertical spacings. By such configuration ability, the shelves can be arranged to most densely store and display products packaged in a variety of sizes. For example, for the stocking of bags of animal food in various sizes, a narrow shelf of, for example, twenty-three inches can be provided to receive twenty pound bags of food, with an adjacent shelf of twenty-four inches in width to receive twenty-five pound bags of food. For forty pound bags of feed, a forty-four inch shelf may be provided. On the shelf immediately above the shelves of each such size, bags of the same size but of a different composition or different brand may be stocked. Then, on the higher top shelf, five and ten pound bags of the respective brands may be stocked. Ultimately, on the higher conventional gondola shelves, smaller items may be stocked. Thus, by selecting the most efficient arrangement, the optimum packout of the system may be achieved.

The stocking system 10 described above combines the advantages of the conventional gondola rack system 11 with the additional advantages of the large container subassembly 12. In addition, the subassembly 12 can be added to conventional gondola rack systems to convert the system to the highly efficient stocking system 10. The system provides optimal density stocking of large container materials of various sizes and types, on structurally strong shelves, with full front shelf edge support, without defeating the purposes and flexibility of system built on the gondola rack concept.

Those skilled in the art will appreciate that the present invention is described herein in its preferred embodiments, but that additions and modifications can be made without departing from the principles of the invention. Accordingly, the following is claimed:

We claim:

1. A stocking system comprising:

a plurality of vertical standards spaced a horizontal distance apart in a vertical plane and upstanding from a horizontal base surface and fixed relative thereto;

at least two rails including an upper rail and a lower rail, each rail being connectable, when extending horizontally to at least one two of the standards, each rail having structure defining a plurality of frame member connectors thereon;

a plurality of at least three generally rectangular vertical upright frame members, each having vertical load supporting front and back supports and horizontal top and bottom supports, each frame member configured to be rigidly connected at a selected one of the plurality of frame member connectors to the rails in a vertical orientation perpendicular to the vertical plane and horizontal surface each of the frame members also having a plurality of vertically spaced shelf rests on the front and back supports thereof to support shelves in selected one of a plurality of vertical shelf positions thereon;

a plurality of rectangular shelves configured to engage the rests of the front and back supports of at least two different combinations of two of the frame members connected to the rails at respective pairs of the connection positions that are spaced apart a distance corresponding to the widths of the respective shelves connected thereto, to support the shelves at the fronts and backs at both sides thereof between pairs of frame members differently spaced along the rail; and the upright frame members each having an anchor connector on at least one of the supports spaced horizontally from the vertical plane to maintain the bottom of the frame vertical in alignment with the top thereof and to maintain the member generally perpendicular to the vertical plane.

2. The stocking system of claim 1 wherein:

each of the standards has a plurality of holes therein spaced at regular vertical intervals thereon, each of the holes being configured to receive a hooked tab of a gondola shelf bracket; and each of the rails being configured to connect the rails to at least one of the standards at at least one of the plurality of holes.

3. The stocking system of claim 2 further comprising:

at least one pair of gondola shelf brackets connected at the same vertical level in the holes of two standards;

a gondola shelf supported on the brackets.

4. The stocking system of claim 1 wherein:

the standards include at least three standards spaced at horizontal intervals each equal to the horizontal distance;

each of the rails is formed of a plurality of rail sections, each section having a length equal to approximately one of the horizontal intervals and each section being configured at each of the ends thereof for connection to one of the standards.

5. The stocking system of claim 4 wherein:

the widths of each of the shelves is less than the horizontal intervals between the standards.

6. The stocking system of claim 1 wherein:

the structure defining the frame member connectors includes a plurality of horizontally spaced holes; and each of the frame members has a pair of hooks on the back thereof configured to attach the frame member at the selected connection position along the rail.

7. The stocking system of claim 6 wherein:

the anchor connector includes a horizontal surface having a plurality of holes therein, each corresponding to one of the horizontally spaced frame member connectors of a rail; and each of the frame members is provided with at least one pin on at least one of the horizontal supports thereof configured to fit in a selected one of the holes in the horizontal surface.

8. The stocking system of claim 1 wherein:

each of a plurality of the shelf rests is in the form of a set of holes aligned at the same vertical level in each of the supports; and each of a plurality of the shelves of each width are provided with a tab at each corner thereof to attach at four points to the supports of the corresponding two frame members.

9. The stocking system of claim 8 wherein:

one of the shelf rests is in the form of structure at the top of the frame members configured to support a top one of a plurality of shelves supported thereon.

10. A gondola rack stocking system comprising:

a plurality of vertical standards rigidly mounted at spaced horizontal intervals in a vertical plane upstanding from a horizontal base foot surface, each of the standards having a plurality of holes therein spaced at vertical intervals thereon, each of the holes being configured to receive a tab of a gondola shelf bracket;

a rail having at least two sets of hooked tabs fixed thereto and each being configured to connect to at least one of the standards to secure the rail horizontally thereto;

a plurality of upright frame members each having a back support at the back thereof and a front support forwardly offset from the back support, each of the supports having a plurality of shelf rests vertically spaced thereon to adjustably support shelves in any of a plurality of vertical positions on the upright frame members;

the upright frame members each having at least one connector toward the top back thereof to support the member in a vertical orientation on the rail;

the rail having a plurality of connector elements spaced therealong, each configured to cooperate with the connector of an upright frame member to secure the member at any of a plurality of horizontal positions along the rail;

the upright frame members each having an anchor connector thereon to maintain the bottom of the frame vertical in alignment with the top thereof and to maintain the member generally perpendicular to the vertical plane;

a first plurality of first shelves of a first width that is less than the horizontal intervals between the standards;

a second plurality of second shelves of a second width that is greater than the first width; and each of the shelves having supporting structure fixed thereto configured to engage selected ones of the shelf rests of two uprights to adjustably support the respective shelf in any one of a plurality of vertical positions thereon.

11. A stocking subsystem for a gondola rack having a plurality of vertical standards rigidly supported and spaced a horizontal distance in a vertical plane on structure upstanding from a horizontal surface, each of the standards having a plurality of holes therein spaced at vertical intervals thereon, each of the holes being configured to receive a tab of a gondola shelf bracket, the subsystem comprising:

at least one rail with at least one rail connector configured to fit into the holes of at least one of the standards to secure the rail horizontally thereto;

a plurality of upright frame members formed of a generally rectangular arrangement of supports including a vertical back support at the back thereof, a vertical front support forwardly offset from the back support and generally parallel thereto, and a pair of vertically spaced cross supports interconnecting the vertical supports, each of the vertical supports having a plurality of shelf rests vertically spaced thereon to adjustably support shelves in any of a plurality of vertical positions on the upright frame members;

the upright frame members each having at least one connector at the back thereof, each configured to connect the member to one rail;

the rail having a plurality of connector engaging elements spaced therealong, each configured to cooperate with the connector of an upright frame member to selectively secure the member at a horizontal position along the rail;

a plurality of shelves of a width that is less than the horizontal distance between the standards;

each of the shelves having supporting structure fixed thereto configured to engage selected corresponding ones of the shelf rests of the front and back supports of two adjacent uprights that are connected to the rail to adjustably support the shelf in a selected one of a plurality of vertical positions on at least four of the supports; and the upright frame members each having an anchor connector thereon to maintain the bottom of the frame vertical in alignment with the top thereof and to maintain the member generally perpendicular to the vertical plane.

12. The stocking subsystem of claim 11 wherein:

each of the rails is formed of a plurality of rail sections, each section having a equal length and each section being configured at each of the ends thereof for connection to one of the standards.

13. A gondola rack stocking system comprising:

a plurality of vertical standards rigidly mounted at spaced horizontal intervals in a vertical plane upstanding from a horizontal base foot surface, each of the standards having a plurality of holes therein spaced at vertical intervals thereon, each of the holes being configured to receive a tab of a gondola shelf bracket;

a rail having at least two sets of hooked tabs fixed thereto;

a plurality of upright frame members each having a back support at the back thereof and a front support forwardly offset from the back support, each of the supports having a plurality of shelf rests vertically spaced thereon to adjustably support shelves in any of a plurality of vertical positions on the upright frame members;

the upright frame members each having an anchor connector thereon to maintain the bottom of the frame vertical in alignment with the top thereof and to maintain the member generally perpendicular to the vertical plane;

a first plurality of first shelves of a first width that is less than the horizontal intervals between the standards;

a second plurality of second shelves of a second width that is greater than the first width;

each of the shelves having supporting structure fixed thereto configured to engage selected ones of the shelf rests of two uprights to adjustably support the respective shelf in any one of a plurality of vertical positions thereon;

the rail being supportable by the tabs thereof in a horizontal orientation adjacent and parallel to the vertical plane, and connectable to at least two of the frame members thereby establishing the relative horizontal positions thereof; and the upright frame members being connectable near the tops thereof to at least two of the standards.

14. The stocking subsystem of claim 13 wherein:

each of a plurality of the shelf rests is in the form of a set of holes aligned at the same vertical level in each of the supports; and each of a plurality of the shelves of each width are provided with a tab at each corner thereof to attach to the at least four supports.

15. The stocking subsystem of claim 13 wherein:

one of the shelf rests is in the form structure at the top of the frame members configured to support a top one of a plurality of shelves supported thereon.

16. The stocking subsystem of claim 13 wherein the plurality of shelves includes:

a first plurality of first shelves of a first width; and a second plurality of second shelves of a second width that is greater than the first width;

the plurality of frame members including at least three frame members connectable to the rail such that two thereof are spaced apart by a distance to support the shelves of the first width and two of thereof are spaced apart a distance to support shelves of the second width.

17. The stocking subsystem of claim 11 wherein:

the anchor connector of each of the frame members is provided with at least one pin on the bottom thereof configured to fit in a selected one of the holes in the horizontal base surface.

18. A stocking subsystem for a gondola rack having a plurality of vertical standards rigidly supported and spaced from each other a horizontal distance in a vertical plane on structure upstanding from a horizontal surface, each of the standards having a plurality of holes therein spaced at vertical intervals thereon, each of the holes being configured to receive a tab of a gondola shelf bracket, the subsystem comprising:

at least one rail element having at least one rail connector configured to fit into holes to support the rail horizontally;

a plurality of upright frame members formed of a generally rectangular arrangement of supports including a vertical back support at the back thereof, a vertical front support forwardly offset from the back support and generally parallel thereto, and a pair of vertically spaced cross supports interconnecting the vertical supports, each of the vertical supports having a plurality of shelf rests vertically spaced thereon to adjustably support shelves in any of a plurality of vertical positions on the upright frame members;

the upright frame members each configured to connect the member to the at least one rail;

a plurality of shelves of a width that is less than the horizontal distance between the standards;

at least one shelf elements connectable to the tops of the frame members;

each of the shelves having supporting structure fixed thereto configured to engage selected corresponding ones of the shelf rests of the front and back supports of two adjacent uprights that are connected to the rail to adjustably support the shelf in a selected one of a plurality of vertical positions on at least four of the supports; and the upright frame members each having an anchor connector thereon to maintain the frame member in a vertical orientation and to maintain the member generally perpendicular to the vertical plane in any one of a plurality of horizontally spaced positions.

19. The stocking system of claim 18 wherein:

the anchor connector of each of the frame members is provided with at least one pin on the bottom thereof configured to fit in a selected one of the holes in the horizontal base surface.

20. The stocking system of claim 18 wherein the plurality of shelves includes:

a first plurality of first shelves of a first width that is less than the horizontal distance between the standards; and a second plurality of second shelves of a second width that is greater than the first width;

the combinations of frame members being connectable to the rails spaced apart by two different distances, one corresponding to each of the first and second width.

21.The stocking system of claim 10 wherein:

the anchor connector of each of the frame members is provided with at least one pin on the bottom thereof configured to fit in a hole in the horizontal base foot surface.

22. The stocking system of claim 13 wherein:

the anchor connector of each of the frame members is provided with at least one pin on one of the cross members thereof configured to fit in a hole spaced from the vertical plane.

23. The stocking system of claim 18 wherein:

the uprights are connectable near the tops thereof through at least one of the elements to the standards.

* * * * *

UNITED STATES PATENT AND TRADEMARK OFFICE

CERTIFICATE OF CORRECTION

PATENT NO. : 5,611,442

DATED : March 18, 1997

INVENTOR(S) : John D. Howard

It is certified that error appears in the above-indentified patent and that said Letters Patent is hereby corrected as shown below:

In the Claims:

In claim 1, column 7, line 62, delete "two"

In the Abstract:

In line 6 of the Abstract, delete "uprights"

Signed and Sealed this

Third Day of March, 1998

*Attest:*

*Attesting Officer*

BRUCE LEHMAN

*Commissioner of Patents and Trademarks*